US005163311A

United States Patent [19]

McClain et al.

[11] Patent Number: 5,163,311

[45] Date of Patent: Nov. 17, 1992

[54] ROLLFORMER FOR VARIABLE WIDTH EDGE PROFILES

[75] Inventors: Lamont R. McClain, St. Louis; Jerry A. Sostman, Pacific, both of Mo.

[73] Assignee: Engel Industries, Inc., St. Louis, Mo.

[21] Appl. No.: 749,317

[22] Filed: Aug. 23, 1991

Related U.S. Application Data

[63] Continuation-in-part of Ser. No. 649,956, Feb. 4, 1991, abandoned.

[51] Int. Cl.[5] ..... B21D 5/08

[52] U.S. Cl. ..... 72/181; 72/247

[58] Field of Search ..... 72/179-181, 72/176, 182, 247, 249

[56] References Cited

U.S. PATENT DOCUMENTS

| | | | |
|---|---|---|---|
| 851,451 | 4/1907 | Steiber | 72/180 |
| 1,673,787 | 6/1928 | Frahm | 72/181 |
| 2,176,115 | 10/1939 | Yoder | 72/181 |
| 3,051,214 | 8/1962 | Rutten | 72/181 |
| 3,595,056 | 7/1971 | Hutton | 72/181 |
| 3,886,779 | 6/1975 | McClain | 72/181 |
| 3,931,725 | 1/1976 | Yon | 72/181 |
| 4,471,641 | 9/1984 | Mitchell | 72/181 |
| 5,056,348 | 10/1991 | Albrecht | 72/180 |

FOREIGN PATENT DOCUMENTS

| | | | |
|---|---|---|---|
| 1777039 | 10/1971 | Fed. Rep. of Germany | 72/181 |
| 27723 | 2/1984 | Japan | 72/181 |

*Primary Examiner*—Daniel C. Crane
*Attorney, Agent, or Firm*—Jerome A. Gross

[57] ABSTRACT

A progressive rollformer machine is readily adjustable, without removal of rolls or use of spacers, to produce sheet metal workpiece margin flanges of variable depth. The machine includes a gear train housing having perpendicularly extending spindle shafts and idler gear shafts, and two forming roll housing sections, with their rolls mounted outboard. One of these, conventionally fixed relative to the gear train housing, provides one reference line of forming. The other forming roll housing section provides a second reference line of forming—it may be positioned at a variable distance from the gear train housing, at a spacing adjustable by a screw drive. Tracking throughout all roll stations is made possible by using the adjustable-position forming roll housing first in line of flow, with supplemental tracking rolls mounted onto the ends of the spindle shafts.

7 Claims, 5 Drawing Sheets

FIG. 8
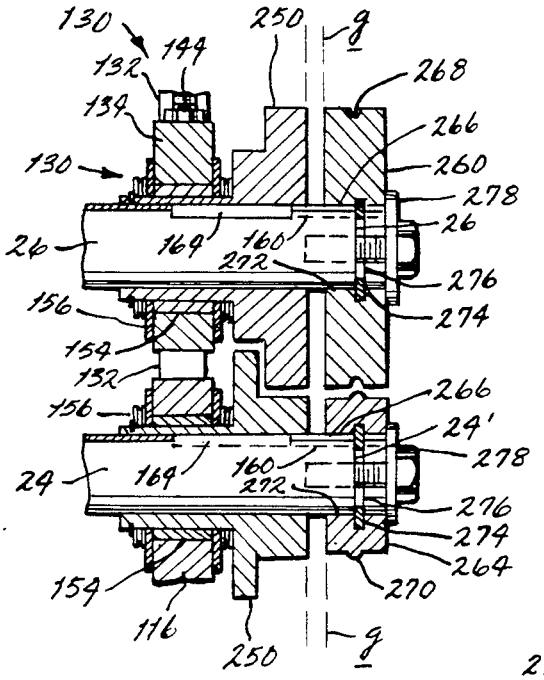
FIG. 9
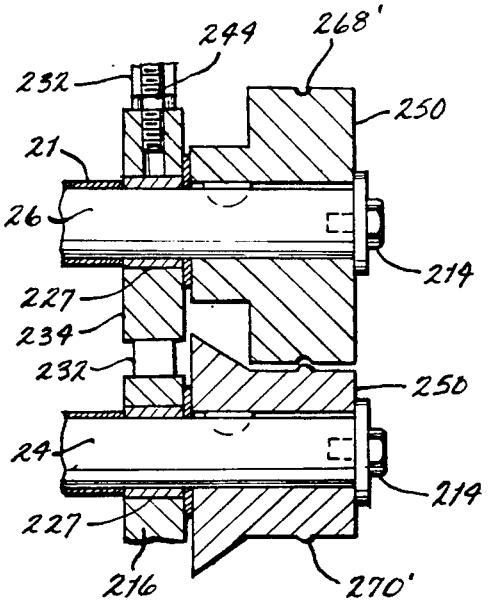
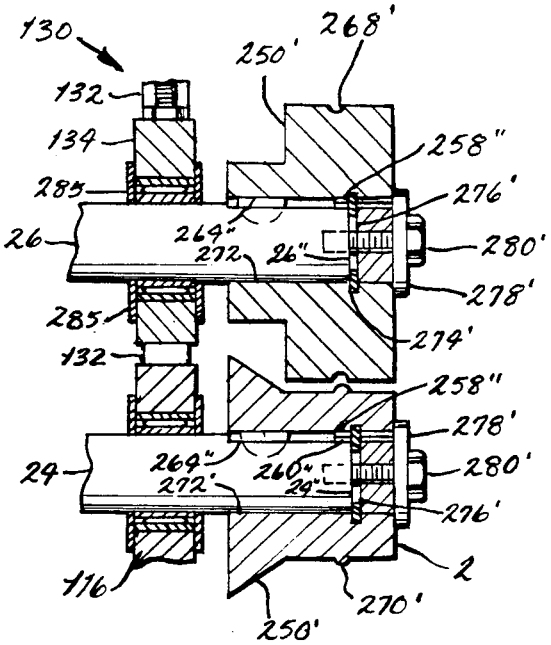
FIG. 10

ROLLFORMER FOR VARIABLE WIDTH EDGE PROFILES

REFERENCE TO RELATED APPLICATIONS

This application is a continuation-in-part of application Ser. No. 07/649,956, filed Feb. 4, 1991, which upon the filing hereof will be abandoned.

BACKGROUND OF THE INVENTION

1. Field of Invention

This invention relates to machines for rollforming sheet metal, and has particular application to rolling edge profiles along one rectilinear edge of a sheet metal duct element or other workpiece, the profile having at least one variable dimension which must be accommodated by shift of some of the forming rolls relative to the others.

2. Description of the Related Art

A typical utilization of rollforming equipment is in the forming of edge flanges on substantially rectangular pieces of sheet metal, such as end edge flanges on sections of heating or cooling ducts.

Known profiles for the end edges of such duct sections include the type of outstanding flange with a succession of bends sized to receive and engage corner-pieces, such as the snap-in flanges shown in U.S. Pat. No. 3,886,779. In this specification, that flange profile is used to illustrate how, utilizing a rollformer machine of the present invention, the end flanges may be formed to variable chosen depths without removing and re-spacing the roll sets.

Specifications applicable to a single duct installation may permit or require the larger cross-section ducts to have substantially deeper flanges than ducts of smaller cross-section. To make a deeper integral flange, the bend line at the base of the flange must be spaced farther from the edge than the bend line at the top of the flange. To change such spacing, as from shallower to deeper, has heretofore required that all the rolls, mounted on those stations of the machine which form the variable part of the flange profile, be removed from the ends of the spindles to which they are secured and other rolls substituted, or, in some instances, re-positioning the original rolls by insertion or removal of spacers.

The problem of varying flange conformation along one edge of a sheet is quite different than that met by familiar "dual head" machines, which simultaneously form opposite edges of a metal workpiece.

Conventional "single head" multi-station progressive roll formers, used for forming integral flanges along one edge of a sheet metal workpiece, are comprised of two principal housing assemblies:

(1) a gear train housing assembly, made up of a lower power train whose alternate gears are mounted on lower roll-driving spindles, and an upper frame portion mounted thereon with provision for yielding under spring pressure, the upper frame portion having meshing gears mounted on upper roll-driving spindles which extend therefrom; and (2) a forming roll housing assembly mounted adjacent to and at a fixed spacing from the gear train housing assembly, made up of a lower frame roll-housing portion and upper frame roll-housing portion similarly mounted yieldably thereon, through which housing assembly on the roll-driving spindles extend with forming rolls mounted on their outboard side.

Where complex bends are to be formed parallel to a sheet metal edge, and inboard of a first set of bends, it is known practice to form in the metal a simple tracking groove (or ridge) at an early roll-form stage, and to accommodate this in the rolls of all subsequent forming stations to assure parallel lines of bend within close tolerances.

SUMMARY OF THE INVENTION

In using the present invention for forming flanges whose depth may be varied, advantage is taken of this fact: although a rollformer machine having say 16 roll stations may be necessary to form the complete profile, the progressive forming about a first reference bend line may be completed in a first roll housing section of say nine roll stations, before a second stage of forming is carried out about a second reference bend line by the remaining seven roll stations.

The term "reference bend line" here used means any one or plurality of bend lines whose spacing relative to each other is fixed. The "first" of such bend lines is that line or plurality of lines which is first formed, normally the line or lines nearest the sheet edge. In conventional design practice, the subsequent rolls following those in which first bends are formed, provide spaces between them to accommodate the bends formed at earlier stations.

In a preferred embodiment of the present invention, the forming roll housing assembly (but not the gear train housing assembly) is divided into two parts, one of which is at an adjustable spacing from the gear train housing assembly. The adjustable housing roll assembly, which may be either first in line of flow or may follow the fixed roll-housing assembly, is shiftable laterally out of alignment with the fixed housing assembly sufficiently to provide the desired range of variation in spacing. Placing the adjustable section first in the line of flow is important where a tracking groove to be utilized in the first stages of forming because their spindle shaft ends provide a second fixed line of reference in addition to the adjustable reference line provided by the adjustable housing itself.

The forming rolls are mounted on the outboard side of the adjustable roll housing assembly, on spindles driven by the gear train housing assembly. To permit this housing assembly to be re-spaced from the gear train housing without impermissible deflection of the driving spindles, the spindles mount and drive, but do not support, the progressive forming rolls. Instead these rolls project outboard from integral hollow hubs bearing-mounted in the adjustable housing assembly structure; the hubs transmit the forming loads directly to the forming roll housing structure. This entire adjustable roll housing structure is supported by and along the idler gear fixed shafts projecting from the lower portion of the gear train housing. Positioning the housing assembly structure laterally, as by a conventional chain, sprocket and screw drive, moves it as a whole axially along the roll spindles; this establishes the desired spacing of the second reference bend line from the first reference bend line.

Where the spacing of bends from each other is not to be adjustable, it is conventional to use a tracking groove, formed at an initial station and followed in each subsequent station to maintain precise spacing and thus maintain tolerances. One problem here presented is how to utilize such a tracking groove despite relative adjustment of the two sections. That problem may be here solved by the alternative of using the adjustable forming section first in line of forming with this feature, which we believe to be entirely novel: although the other forming rolls of this adjustable section are slidably positioned along the splined driving spindles, the tracking rolls in the adjustable section are mounted in fixed linear position onto the spindle ends, in alignment with corresponding tracking provisions of the following fixed section forming rolls.

BRIEF DESCRIPTION OF THE DRAWINGS

FIG. 8 is a fragmentary view similar to FIG. 6 of an adjustable roll housing portion on whose spindle ends are mounted rolls initially to form, and, in later stages, to follow, a tracking groove.

FIG. 9 is a fragmentary view similar to FIG. 7 showing the general conformation of the forming rolls of such fixed-position roll housing which follows, in line of flow, the adjustable-position roll housing portion and rolls illustrated in FIG. 8.

FIG. 10 is a fragmentary view of an alternative embodiment of invention showing how rolls having the same conformation as those of the fixed-position following rolls of FIG. 9 may be attached in the same fixed position on spindles of an adjustable housing portion.

DESCRIPTION OF THE PREFERRED EMBODIMENT

Problem Met by the Invention

Figure 1:
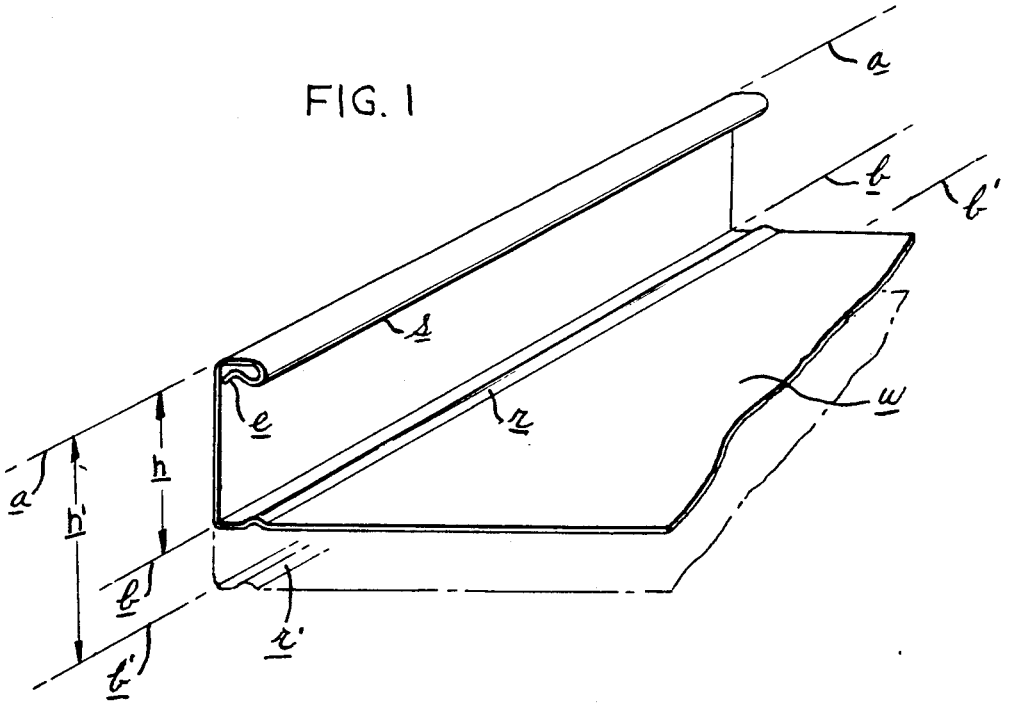
PRIOR ART FIG. 1
FIG. 1 is a fragmentary sketch of a type of duct flange whose height may be varied by the roll forming machine of the present invention, as from the height h to the greater height h'.

The machine of the present invention may advantageously be used to form that type of integral duct which was illustrated in U.S. Pat. No. 4,579,375, entitled "Sheet Metal Duct System Having Integral Transverse Flanges." Such flanges illustrated in FIG. 1, are formed integrally at the ends of the walls w of a duct section. In the forming of several parallel bend lines along the edges of sheet metal workpieces, the lines of bend nearest the workpiece edge are formed first; progressive stations of roll forming must reach farther inward from the edge e of the metal. The several bends are thus measured from the edge e of the sheet metal; nearest is a spring bend s of 180° or more, and next is a 90° bend line a—a which demarks the height of the flange to be formed at a height h from the wall w. Since these bend lines are always at a fixed spacing, either may be considered as a first reference line of bend; but since the flange height is the point of interest, the bend line a—a will be here taken as a first reference line of bend.

A second reference line of bend b—b, where the sheet metal is bent outward from the duct wall w, is shown in solid lines at a distance h from the line a—a; by the present invention that distance may be varied to the greater flange height h' by moving the second reference line of bend to the position b'—b', farther from the workpiece edge e. A tracking or reference ridge r or r' is formed at a fixed spacing from such second reference line of bend b—b or b'—b', completing the duct flange which traps a duct cornerpiece, not shown.

Figure 3:
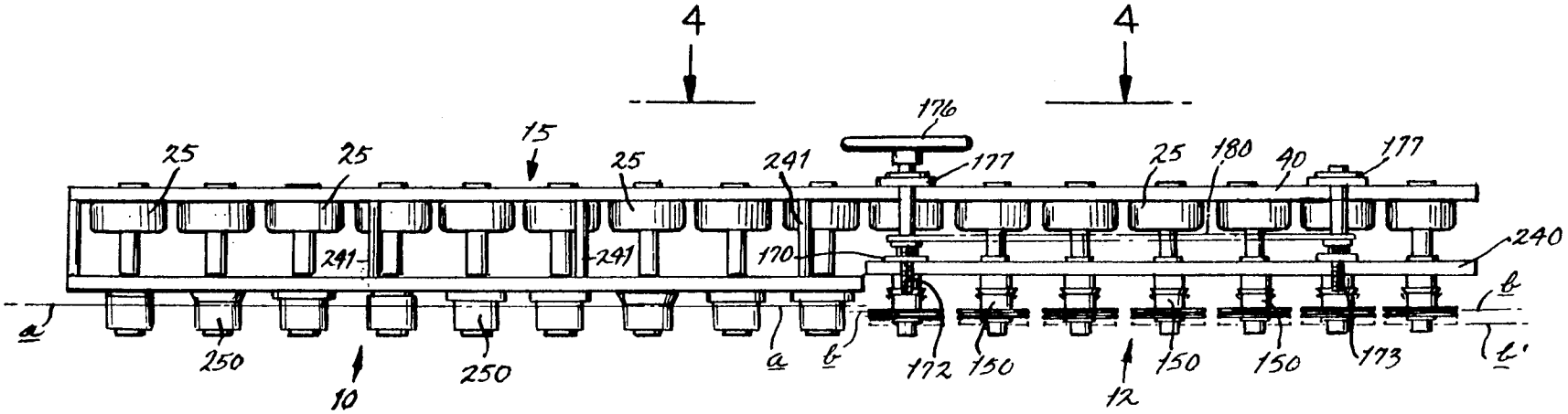
FIG. 3 is a partly schematic plan view of the roll former machine of FIG. 2. The portion to the left of the adjustment wheel is substantially conventional. The phantom lines show adjustable positioning to change the flange height from h to h'.

In an original embodiment of the present invention, here illustrated somewhat simplified in the plan view FIG. 3, there is shown a first reference line of bend a—a formed by a conventional portion of the machine, and a second variable positioned line of bend b—b. The problem of adjusting the spacing of the second reference line of bend over a range from b—b to b'—b', (the roll position shown in phantom lines in FIGS. 3 and 4) was originally solved by utilizing a conventional fixed-position roll-housing section generally designated 10 comprised of say nine roll-forming stations, followed by an adjustable-positioned roll housing section generally designated 12, of say seven stations, both powered by an essentially conventional single continuous gear train housing assembly generally designated 15. In a model embodiment, later described, the adjustable-positioned roll housing section precedes the fixed-position section in line of flow. It is understood that all bends positioned at a fixed distance from the edge e are completed in whichever roll-housing section 10, fixed or adjustably positioned, is first in the line of flow.

The Gear Train Housing Assembly

Figure 4:
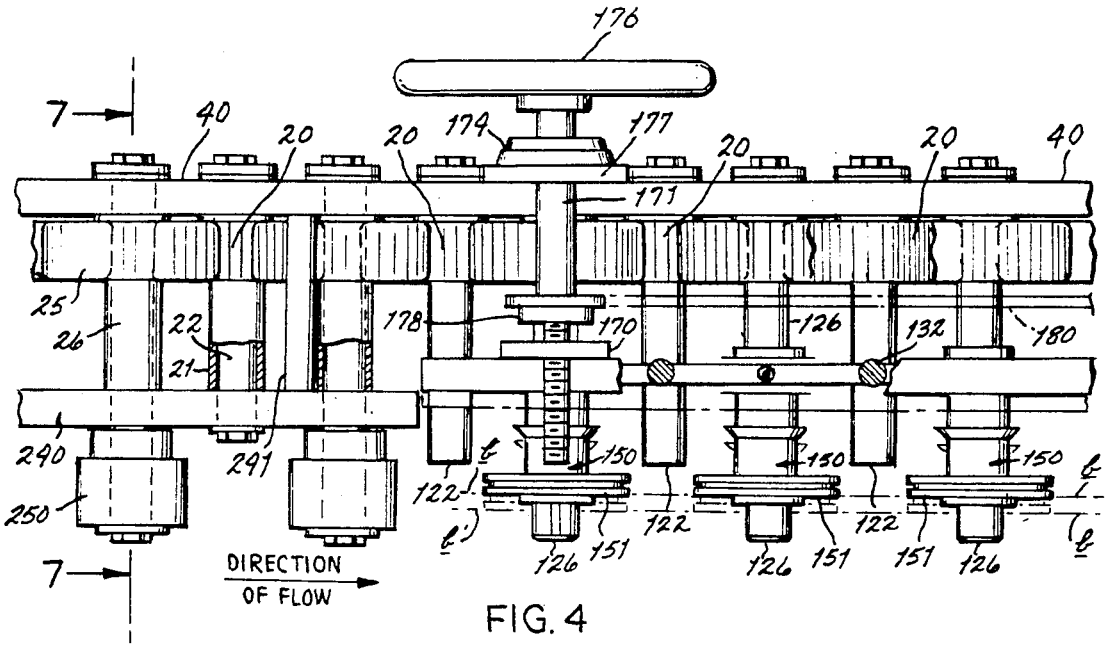
FIG. 4 is an enlarged plan view of the segment 4—4 of FIG. 3, showing somewhat greater detail.
Figure 5:
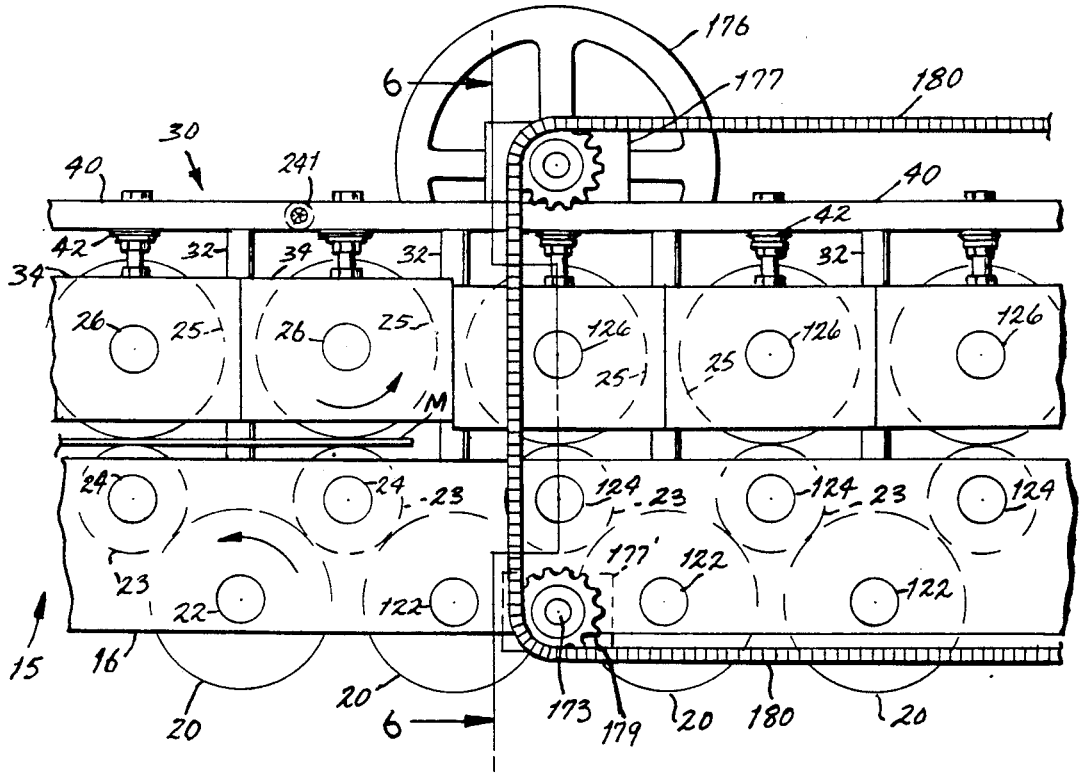
FIG. 5 is a partial section taken along line 5—5 of FIG. 4, illustrating at left the upward-yielding deflection of the upper bearing cages as a metal sheet passes between the forming rolls.

The gear train housing assembly 15, seen schematically at the top of FIG. 3, and in somewhat greater detail in FIGS. 4, 5, 6 and 7, is based on a lower vertical housing plate 16 (see FIGS. 5, 6 and 7) which extends continuously for all 16 stations of the machine and is firmly and fixedly supported from the floor by conventional machine support means, not shown. FIG. 5 illustrates in the region corresponding to that where the fixed-position forming roll housing portion 10 meets the adjustable position forming roll housing 12. It is understood that, according to conventional practice, lubrication provisions, retention rings and thrust washers are utilized; in some instances these elements are omitted from this description as well as from the drawings. Also, while lubricated needle bearings are preferred over bushings for use in all conventional points of installation, bushings are shown in the drawings in some instances for clarity and simplicity of illustration.

Figure 2:
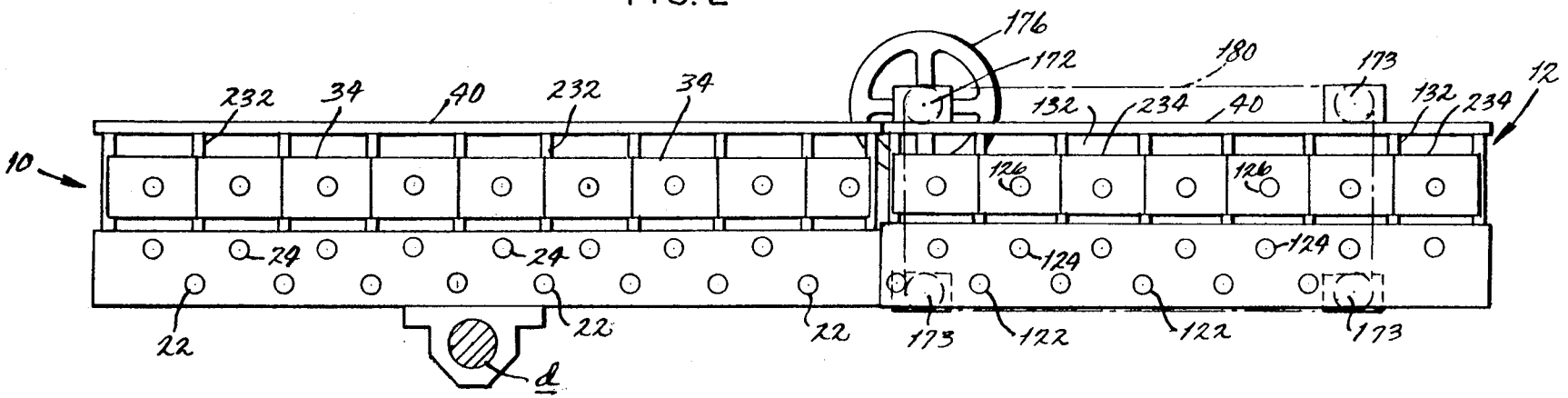
FIG. 2 is a partly schematic elevational view, taken from the forming roll housing side, of a roll former machine embodying the present invention.

Power to the gear train of the assembly 15 is supplied through a drive shaft d indicated in FIG. 2, at one or more convenient points in the power train, to idler gears 20 whose paths of rotation are indicated near the left of FIG. 5. The idler gears 20 are mounted for rotation on idler shafts 22, 122, shown in FIGS. 4, 7 and 6, which extend across to the forming roll housing assemblies 10, 12, to be described. The idler shafts 122, at the right of FIGS. 4 and 5, which extend through and support the adjustable roll housing assembly 12 are longer (and may for added strength, be of larger diameter) than the shafts 22.

On lower driving spindle shafts 24 (see FIGS. 6 and 7), supported and conventionally lubricated in bearings 27 in the lower gear train housing plate 16, at a level above the idler shafts 22, are mounted driving gears 23, whose paths are indicated in FIG. 5, their positions so alternating between the idler gears 20 as to deliver power along the entire length of the gear train housing assembly 15. It is understood that the lower driving gears 23 and the upper driven gears 25 may be of the same diameter, or one set or the other may be larger, in which case the forming rolls which are driven by their spindles will be formed accordingly.

Figure 7:
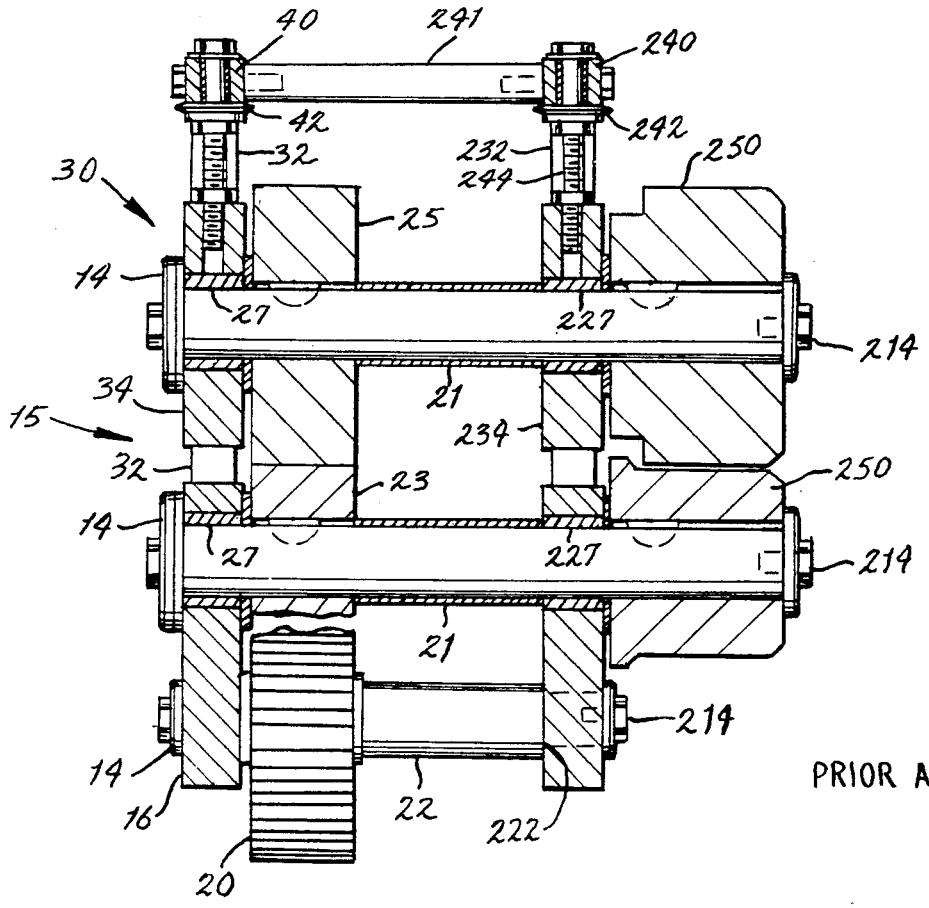
FIG. 7 is a sectional view taken along line 7—7 of FIG. 4 and typical of the substantially conventional fixed position portion of the machine.
Figure 6:
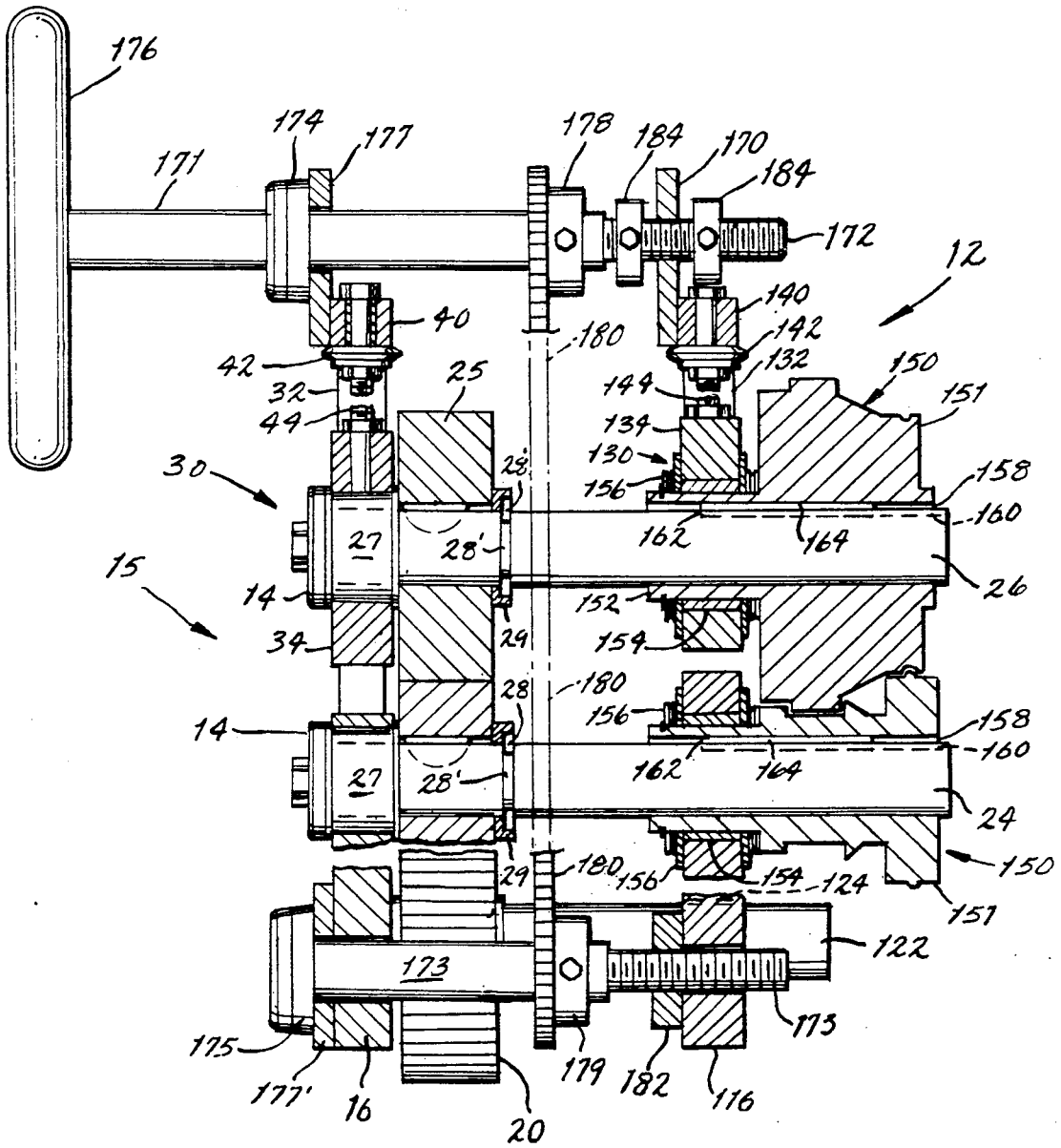
FIG. 6 is a cross-section taken along the broken section line 6—6 of FIG. 5.

Completing this assembly and referring to FIGS. 5, 6 and 7, onto the upper edge of the lower vertical plate 16 is mounted a conventional superstructure, here referred to as the upper or driven gear sub-assembly generally designated 30. It includes round vertical guide posts 32 sunk and force-fitted in the plate 16, between which upper bearing cages 34 are slidably mounted (similar yieldable superstructure in the adjustable housing roll assembly 12 is shown in FIG. 6 as the posts 132 and bearing cages 134). Each bearing cage 34, 134 at its center mounts a lubricated bearing 27 holding an upper spindle shaft 26 to which is keyed a driven gear 25 in mesh with the driving gear 23 directly beneath. A longitudinal head rail 40 is held down by screws (not shown) into the upper ends of the guide posts 32. Together with similar provisions at the forming roll housings 10, 12, they resist upward-yielding of the bearing cages 34 as sheet metal m (whose position is illustrated in phantom lines at the left of FIG. 5) passes through the forming rolls. Such upward yielding is elastically resisted by pairs of opposed cupped washers 42 compressed upwardly, to bear upward against the undersurface of the header bar 40; their resistance is controlled by conventional adjustment screws 44 which are seated into the upper surfaces of the bearing cages 34. This same bearing cage-guide post construction is utilized atop both the fixed-position and adjustable-position roll former housing assemblies 10, 12.

Referring to FIG. 5, while the gear train housing assembly 15 is generally the same throughout the entire 16 stations for the seven adjustable roll stations, this difference exists: only those lower driving gears 23 and upper driven gears 25 which drive the adjustable position forming roll housing 12 are held on their spindle shafts by conventional steel C-spacers 28 of 180° extent (their open ends being shown in FIG. 6), set in grooves 28' on their shafts and retained in place by C-spacer cages 29. As to securing those gears 23, 25 which drive the fixed-position roll housing 10, see the description of FIG. 7 which follows.

Adjustable-Position Roll Housing Assembly

The adjustable-position roll housing assembly 12, shown at the right of FIG. 6, and the provisions for its support and adjustment, will now be described. This description is applicable whether or not the adjustable-position roll housing precedes the conventional fixed-position roll housing in line of flow; but such first positioning is necessary where tracking roll provisions are to be utilized in both roll forming sections.

The idler gear shafts 122, best seen in FIGS. 4 and 6, are cantilevered from the vertical plate 16 of the gear train housing assembly; they extend a length sufficient to project slidably through closely fitting bores 124 in the vertical plate 116 of the forming roll housing adjustable assembly 12, thereby supporting the entire assembly 12 over its entire range of adjustment seen in FIGS. 3 and 4.

Mounted as a superstructure on the upper edge of the vertical plate 116, by provisions similar to those of the yieldable upper driven gear assembly 30, is the upper yieldable adjustable-position forming roll housing assembly generally designated 130, including round guide posts 132 between which forming roll-bearing cages 134 may yield upwardly, held down by a longitudinal head rail 140 secured to the upper ends of the guide posts 132; further including provisions to oppose upward movement of the forming roll-bearing cages, which comprise adjustment screws 144 communicating upward force against the head rail 140 through opposed cupped washers 142.

The manner in which its upper and lower adjustable forming rolls generally designated 150 are formed, mounted and driven will now be described. It is to be understood that neither the description which follows, nor the accompanying drawings describe and show the precise design configurations of the progressive forming rolls 150, 250 which form the type of duct flange shown in FIG. 1, such matters being within the scope of knowledge and judgment of roll design engineers.

The rolls 150 (whose tracking groove-forming portions 151 are shown in FIG. 4) are not mounted in fixed axial position on the spindle shafts 24, 26. Instead both upper and lower forming rolls 150 have integral hub portions 152 whose outer surfaces fit within surrounding bearings 154 in the bearing cages 134 and lower vertical plate 116, and are there securely retained by thrust washers 156 for axial adjustment. Central bores (not numbered) through the upper and lower forming rolls 150 and their hub portions 152 permit their free axial movement along the spindle shafts 24, 26 as the spacing of the adjustable-position roll housing assembly 12 from the gear train housing assembly 15 is adjusted. Their range of movement is from an innermost position closest to the gear train housing to an outermost position spacedly inward of the spindle ends. Such free axial movement is achieved as now to be described.

A roll bore keyway 158 is cut through the entire bore of each adjustable forming roll 150, including its hub portion 152. A shaft keyway 160 of the same width is cut; it extends inward from the end of each of the spindle shafts 124, 126 for a length which may be about as long as the forming roll bore but ends as shown, to provide an inner keyway end 162. On aligning angular each roll bore keyway 158 with its shaft keyway 160, an elongated rectangular key 164 is fitted within them and lodged against the keyway end 162. As seen from FIG. 6, this keying causes the rolls 150 to be driven positively by their spindles 124, 126 while they remain free to be moved axially thereon as the vertical plate 116 bearing the entire adjustable-position forming roll housing assembly 130 is moved laterally along the extended idler gear shafts 122.

In the embodiment of invention heretofore described, the flow of material to be formed is from the fixed position roll housing assembly to the adjustable-position roll housing assembly, as shown by the flow arrow of FIG. 4. Using that arrangement, forming the tracking ridge r, r', shown in FIG. 1, cannot take place until the adjustable section is reached, because of the difference in spacing of the ridges r, r' from the sheet edge. This matter is discussed hereinafter under the heading "Alternate Flow Direction"

Screw provisions for setting the spacing of the adjustable-position roll housing assembly 12 from the gear train assembly 15 are conveniently positioned near each end of the adjustable roll housing assembly 12, as shown schematically in FIG. 2. The driving mechanism, illustrated at the broken cross-section 6—6 of FIG. 5, is shown in substantial detail in FIG. 6. For clarity of illustration, the adjustable roll housing assembly 12 is there shown in a position about midway between its adjustable stops 184 hereafter referred to.

Secured as by welding to the head rail 140 at the top of the adjustable-position forming roll housing assembly 130 (as seen at the upper left of FIG. 6) and extending upward therefrom near each end thereof, are internal-threaded lead screw adaptors 170, being here shown as internally threaded rectangular plates, whose screw threads are in horizontal alignment with the external threads at the end of lead screws, controlled by the driving lead screw 172. This driving lead screw 172 is supported and positioned by an upper driving bearing mount 174, attached to a small rectangular mounting plate 177 which extends similarly upward from its welded connection to the head rail 40 of the gear train housing assembly 15. The mounting plate 177 has an oversize bore through which passes the shaft 171 of the lead screw 172. A hand wheel 176 is mounted on the outer end of the lead screw shaft 171.

A driving sprocket 178 is fixed by a set screw to the driving lead screw 172; it drives a chain 180 which passes vertically down to a first driven sprocket 179 securely mounted onto a driven lead screw 173. The driven lead screw 173 is positioned by a driven bearing mount 175 secured to the gear train assembly plate 16 by a lower rectangular plate 177', both these plates are bored to permit the driven lead screw 173 to rotate in its bearing mount 175.

An internally threaded lead screw adaptor 182 is securely mounted to the lower portion of the vertical plate 116 of the adjustable-positioned roll former housing assembly 12; the plate 116 is likewise bored to permit passage of the driven lead screw 173. Similar driven bearing mounts, both upper and lower, holding driven lead screws, which engage lower and upper lead screw adaptors, are correspondingly mounted just beyond the 15th roll former station, or at some other convenient location.

Turning the hand wheel 176 drives the chain 180 in either direction, setting the spacing of the entire adjustable-position roll former housing assembly 12 from the gear train housing assembly 15, within the limits set by adjustable threaded stops 184 mounted on the driving lead screw 172 on opposite sides of the lead screw adaptor 170, and secured in their selected positions by set screws.

Fixed-Position Roll Housing Assembly

FIG. 7 shows a typical vertical cross-section of nine fixed-position stations of the present sixteen-station machine, as may be seen along line 7—7 of FIG. 4. The gear train housing portion 15, shown to the left, is generally the same as shown in the left of FIG. 6, (without the screw-adjustment provisions shown at the top and bottom of that figure), except that the driving and driven gears 23, 25 are held in alignment on their shafts 24, 26 by tubular spacers 21 which extend from these gears to and against bearings 227 in the fixed-position roll housing assembly 10, in both its vertical lower plate 216 and its upper bearing cage 234. Heavy end cap washers 14 are bolted against both ends of the shafts 24, 26.

At the ends of the idler shafts 22 leading to the fixed-position section roll housing section 10, they are necked down to provide shoulders 222, seen in FIGS. 4 and 7; the reduced diameter shaft portions at their ends fit through bores in the vertical plate 216, to which the idler shafts 22 are clamped by cap washers 214. They thus secure the vertical plate 216 fixedly to the corresponding plate 16 of the gear train housing assembly 15.

The upper yieldable structure of the fixed-position forming roll housing assembly 10 is similar to that of the adjustable-position forming roll housing assembly 12, in having vertical guide posts 232, firmly driven into the upper edge of the vertical plate 216, and to whose upper ends a head rail 240 is securely bolted. For fixed spacing from the upper driven gear assembly 30, the head rail 240 is secured at convenient intervals by fixed spreader rods 241, seen in FIGS. 4, 5 and 7, reaching horizontally to the head rail 40 of the gear train assembly 15. Bearing cages 234 which may yield upwardly along the guide posts 232 are controlled by adjustment screw provisions 244 which bear, through cupped washers 242, against the head rail 240.

Unlike the adjustable-positioned forming roll housing assembly 12 of FIG. 6, in the fixed position assembly 10 of FIG. 7 the lower and upper spindle shafts 24, 26 are themselves supported by bearings 227 in the forming roll housing lower plate 216 and bearing cages 34, 234. Forming rolls 250, keyed to the spindle shaft outer ends, are mounted against the lower plate 216 and bearing cages 234 (separated by conventional bronze thrust rings or the like, not shown) and retained in place by heavy end cap washers 214.

The construction shown in FIG. 7 is typical of all stations of familiar prior art roll forming machines. If a change in reference bend line of forming was desired (as from b—b to b'—b' in the present example), it was necessary to remove all forming rolls and either replace them with other rolls or respace them by interposing spacing washers. The "down" time required, to do this on a multi-station forming machine would be an hour or so, as compared with seconds for changing the position of the adjustable-position roll housing assembly 12 of the present invention, between the extreme positions established by the threaded stops 184.

Alternate Flow Direction

The stresses attendant to progressively forming complex profiles over the entire length of a sheet metal part (in the present example, the four edges of a duct section) may cause the sheet metal to run out sufficiently from precise parallism to create a tolerance problem, especially where the rolls are designed to permit forming of a range of great gages of sheet metal. Since the tracking ridge is associated with the second reference line of bend, whose spacing from the first reference line of bend is adjustable, this adjustable feature would seemingly prevent the initiation of tracking in the early forming stations.

We have discovered how to obtain such tracking starting with the very first forming station. If enough adjustable forming stations are provided to complete forming about the first reference line of bend a, the sense of rotation of the power train may be reversed, and adjustable forming rolls 250 suitable for forming relative to the reference bend line a, are mounted in order starting from that end. In addition, tracking rolls 260, not adjustable, are mounted in fixed alignment on the ends of the spindle shafts 24, 26. The tracking ridge they provide is thus positioned at an adjustable spacing from the first reference line of bend a. The rolls of the following fixed-position section of the machine, shown in FIG. 9, can thus follow the tracking ridge formed at the adjustable stations.

The fragmentary view FIG. 8 shows in detail how the previously described adjustable roll housing of FIG. 6 may be adapted to add tracking rolls; its portions identical to those previously described are numbered with the same part numbers. The principal forming rolls used at a typical station, numbered 250, are shown somewhat schematically. Upper and lower tracking rolls 260, 264, are fitted with rectangular keys (not shown) into the spindle shaft keyways 160 outward of the rectangular keys 164 which hold the adjustable forming rolls 250 in place. The roll bores 272 in the tracking rolls 260, 264 have, at about their mid-width, circumferential internal grooves 274 in which conventional snap rings 276 are fitted, to project inward. For mounting these tracking rolls 260, 264, the snap rings 276 in their bores 272 are brought into contact with the spindle ends 24', 26'; end washers 278 are positioned against the outer surfaces of the rolls 260, 264; and clamping screws 280 clamp the washers 278 to secure the tracking rolls in fixed alignment relative to the spindle ends 24', 26'.

The effect of utilizing this construction on an adjustable housing assembly is as follows: on turning of the adjustment hand wheel 176 a gap g, shown in FIG. 8, between the upper and lower adjustable forming rolls 150 and the upper and lower ridge-and-groove tracking rolls 262, is widened or narrowed; but the positions of the ridge-and-groove tracking rolls 264, 260 is unchanged. This permits precise tracking in the fixed position roll housing assembly 10 when used, as hereafter described, in the line of flow following the flow through the adjustable position rolls 150.

FIG. 9 shows fixed position following rolls 250' of the fixed-position roll housing assembly when so used in position following the adjustable assembly of FIG. 8. These rolls 250' are constructed and assembled similarly to FIG. 7, but have in addition the circumferential tracking grooves 268' and ridges 270' corresponding to those grooves and ridges 268, 270 of the tracking rolls 262 of FIG. 8. Together they guide the sheet metal being formed, assuring continued parallel alignment.

While the upper and lower rolls 260 have here been referred to as "tracking rolls", it should be noted that they may be configured to form more complex contours; their function is not inherently limited to tracking. They are fixed position forming rolls on the spindle ends 24', 26' of the adjustable housing section; they initiate forming relative to the second reference bend line b.

Other Modifications

Certain utilizations will arise in which the designer may be uncertain how many adjustable stations he wishes to use and how many fixed stations. By the construction hereafter described, illustrated in FIG. 10, adjustable stations may be converted into fixed-position stations.

In FIG. 10 the basic adjustable housing structure is the same as in FIG. 8, with an upper yieldable adjustable-position forming roll housing assembly generally designated 130 mounted by round guideposts 132 on the upper edge of the vertical adjustable-position housing plate 116. In this case, however, the bearing cages 134 and the corresponding bores in the housing plate 116 are filled with spindle-supporting needle bearings 285, which may slide along the spindle shafts 24, 26 as they continue to support them. In this utilization, upper and lower forming rolls 250'' have both the tracking groove-and-ridge provisions 268', 270' of FIG. 9 and the forming roll provisions 250' thereof, also having the internal snap rings 276' fitted within internal circumferential grooves 274' in roll bores 272', for attachment by end washers 278' and clamping screws 280' to the spindle ends 24'', 26''.

This construction permits the roll designer to use, as fixed stations, those which were designed for adjustment; or even to build the machine with all forming stations adjustable, converting selected stations to fixed-position use as shown.

An obvious utilization of the present invention is in a "dual head" machine, in which substantially two machines as here illustrated are utilized having their roll housing assemblies facing each other at an adjustable distance, to form both edges of a sheet of metal simultaneously, normally utilizing a single power source to their gear trains.

As various modifications may be made in the constructions herein described and illustrated without departing from the scope of the invention, it is intended that all matter contained in the foregoing description or shown in the accompanying drawings shall be taken as illustrative rather than limiting.

We claim:

1. A progressive rollformer machine comprising (A) a gear train housing assembly including a lower gear train frame portion mounting lower spindle shafts extending perpendicular thereto and driving gears mounted on said lower spindle shafts, further mounting, intermediate said spindle shafts and at a lower level, fixed idler shafts bearing idler gears in mesh with said driving gears, said gear train housing assembly further having an upper gear train frame portion yieldably mounted on said lower frame portion so as to permit upward movement relative to said lower gear train frame portion, said upper frame portion mounting upper spindle shafts having driven gears mounted thereon in mesh with the driving gears of said lower shafts, said rollformer machine further comprising (B) an adjustable forming roll housing assembly including a lower forming roll frame portion through which said lower spindles extend, longitudinal keyways in the so-extending portions of said spindles, and lower forming rolls, mounted outboard of said frame portion and keyed to said lower spindle keyways for axially-slidable positioning along and driving by said spindles, said adjustable forming roll housing assembly further having an upper forming roll frame portion yieldably mounted on said lower forming roll frame portion so as to permit upward movement relative to said lower forming roll frame portion, through which upper frame portion said upper spindles extend, longitudinal keyways in the so-extending portions of said spindles, and upper forming rolls mounted outboard of said upper frame portion and keyed to said upper spindle keyways for axially-slidable positioning along and driving by said upper spindles, each said lower and upper forming rolls having a hub portion including a central bore through which one said spindle extends and a radially outer hub surface bearing-mounted in and retained by said lower or upper forming roll housing assembly, whereby forces attendant to forming by said forming rolls of said adjustable forming roll housing assembly are transmitted in a cantilevered fashion by said radially outer hub surfaces to said lower or upper forming roll frame portions, together with (C) means to support said adjustable forming roll housing assembly at an adjustable spacing from said gear train housing assembly, said means to support comprising (1) extending portions of said fixed idler shafts which portions extend from said lower gear train frame portion at least the extent of such adjustable spacing of the forming roll housing assembly from the gear train housing assembly, and (2) support bores through said lower forming roll frame portion for axially slidingly accommodating said extending idler shafts, together further with (D) means to adjust the spacing of said forming roll assembly from said gear train housing assembly, whereby said upper and lower forming rolls are simultaneously positioned along their said driving spindles from innermost positions to outermost positions.

2. A progressive roll former machine as defined in claim 1, further having base support means for said machine secured to said lower gear train frame position, whereby said fixed idler shafts provide cantilevered support for said forming roll housing assembly.

3. A progressive rollformer machine as defined in claim 1, wherein said means to adjust the spacing of said forming roll housing assembly from said gear train housing assembly along said means to support comprises lower screw-adjustable means extending from said lower gear train frame portion to said lower forming roll frame portion, and upper screw-adjustable means extending from said upper power train frame portion to said upper forming roll frame portion, together with chain-and-sprocket drive means operatively interconnecting said lower and upper screw-adjustable means.

4. A progressive rollformer machine comprising (A) a gear train housing assembly including a lower gear train frame portion extending the length of and mounting a succession of lower spindle shafts extending perpendicular thereto and driving gears mounted on said lower spindle shafts, further mounting, intermediate said spindle shafts and at a lower level, fixed idler shafts bearing idler gears in mesh with said driving gears, said gear train housing assembly further having an upper gear train frame portion yieldably mounted on said lower frame portion so as to permit upward movement relative to said lower gear train frame portion, said upper frame portion mounting upper spindle shafts having driven gears mounted thereon in mesh with the driving gears of said lower shafts, said rollformer machine further comprising (B) an adjustable forming roll housing assembly whose length corresponds to a portion only of said length of said gear train housing assembly, said adjustable forming roll housing assembly including a lower forming roll frame portion through which said lower spindles extend, longitudinal keyways in the so-extending portions of said spindles, and lower forming rolls mounted outboard of said frame portion and keyed to said lower spindle keyways for axially-slidable positioning along and driving by said spindles, said adjustable forming roll housing assembly further having an upper forming roll frame portion yieldably mounted on said lower forming roll frame portion so as to permit upward movement relative to said lower forming roll frame portion, through which upper frame portion said upper spindles extend, longitudinal keyways in the so-extending portions of said spindles, and upper forming rolls mounted outboard of said upper frame portion and keyed to said upper spindle keyways for axially-slidable positioning along and driving by said upper spindles, each said lower and upper forming rolls of said adjustable forming roll housing assembly having a hub portion including a central bore through which one said spindle extends and a radially outer hub surface bearing-mounted in and retained by said lower or upper forming roll housing assembly, whereby forces attendant to forming by said forming rolls of said adjustable forming roll housing assembly are transmitted in a cantilevered fashion by said radially outer hub surfaces to said lower or upper forming roll frame portions, together with (C) a fixed-position forming roll housing assembly whose length corresponds substantially to the remaining portion of said length of said gear train housing assembly, and having upper and lower frame portions through which said spindle shafts extend and forming rolls mounted on said spindle shafts, (D) means to support said forming roll housing assembly at an adjustable spacing from said gear train housing assembly, whereby said upper and lower forming rolls of said adjustable assembly are supported and simultaneously positioned along their said driving spindles from innermost positions to outermost positions, thereby to vary the lateral spacing of the forming rolls of said adjustable forming roll housing assembly from said fixed-position forming roll housing assembly.

5. A progressive rollformer machine as defined in claim 4, wherein said means to support at an adjustable spacing comprise extending portions of said fixed idler shafts which portions extend from said lower gear train frame portion at least the extent of such adjustable spacing of the forming roll housing assembly from the gear train housing assembly, and support bores through said lower forming roll frame portion for slidingly accommodating said extending idler shafts.

6. A progressive rollformer machine as defined in claim 4 wherein said adjustable forming roll housing spindles have ends extending beyond such outermost positions of the forming rolls, and, mounted in fixed position on said ends, supplemental rolls for track forming and track following, and wherein said fixed position forming roll housing assembly follows said adjustable forming roll housing assembly in line of flow, and said forming rolls of said fixed position housing assembly include tracking groove following provisions in rectilinear alignment with said tracking groove portions of said supplemental rolls of said adjustable forming roll housing assembly.

7. For progressive forming, a progressive rollformer machine comprising (A) a gear train housing assembly including a lower gear train frame portion mounting lower spindle shafts extending perpendicular thereto and driving gears mounted on said lower spindle shafts, further mounting, intermediate said spindle shafts and at a lower level, fixed idler shafts bearing idler gears in mesh with said driving gears, said gear train housing assembly further having 'an upper gear train frame portion yieldably mounted on said lower frame portion so as to permit upward movement relative to said lower gear train frame portion said upper frame portion mounting upper spindle shafts having driven gears mounted thereon in mesh with the driving gears of said lower shafts, said rollformer machine further comprising (B) an adjustable forming roll housing assembly including a lower forming roll frame portion through which said lower spindles extend, longitudinal keyways in the so-extending portions of said spindles, and an upper forming roll frame portion yieldably mounted on said lower forming roll frame portion so as to permit upward adjustment relative to said lower forming roll frame portion, through which upper frame portion said upper spindles extend, and longitudinal keyways in the so-extending portions of said spindles, (C) said adjustable forming roll housing assembly having at each of a selected number of roll stations first in the line of flow, adjustably-positioned forming rolls having hub portions including a central bore through which one said spindle extends and a radially outer hub surface bearing-mounted in and retained by said forming roll housing assembly, said forming rolls being mounted outboard of said frame portions whereby forces attendant to forming by said forming rolls of said adjustable forming roll housing assembly are transmitted in a cantilevered fashion by said radially outer hub surfaces to said lower or upper forming roll frame portions, said forming rolls being further keyed to such spindle keyways for driving by said spindles and for axially-slidable positioning from an innermost position to outermost position beyond which end portions of said spindles extend, and, having supplemental tracking rolls mounted on said extending spindle portions and (D) said adjustable forming roll housing assembly further having on the roll stations following said adjustable positioned forming rolls in the line of flow, rolls mounted on the ends of the spindles of said stations, having both tracking groove portions and forming roll portions inward of said tracking portions, in further combination with (E) means to support said forming roll housing assembly at an adjustable spacing from said gear train housing assembly and (F) means to adjust the spacing of said forming roll assembly from said gear train housing assembly.

* * * * *